US010408210B2

(12) United States Patent
Chang et al.

(10) Patent No.: US 10,408,210 B2
(45) Date of Patent: Sep. 10, 2019

(54) DRIVING CIRCUIT FOR PIEZOELECTRIC PUMP AND CONTROL METHOD THEREOF

(71) Applicant: MICROJET TECHNOLOGY CO., LTD., Hsinchu (TW)

(72) Inventors: Ying-Lun Chang, Hsinchu (TW); Shih-Chang Chen, Hsinchu (TW); Jia-Yu Liao, Hsinchu (TW)

(73) Assignee: MICROJET TECHNOLOGY CO., LTD., Hsinchu (TW)

( * ) Notice: Subject to any disclaimer, the term of this patent is extended or adjusted under 35 U.S.C. 154(b) by 207 days.

(21) Appl. No.: 15/414,788

(22) Filed: Jan. 25, 2017

(65) Prior Publication Data

US 2017/0218948 A1 Aug. 3, 2017

(30) Foreign Application Priority Data

Feb. 3, 2016 (TW) ..... 105103429 A

(51) Int. Cl.

| | |
|---|---|
| ***F04B 49/20*** | (2006.01) |
| ***F04B 45/047*** | (2006.01) |
| ***F04B 49/06*** | (2006.01) |
| ***F04B 51/00*** | (2006.01) |

(52) U.S. Cl.

CPC ..... *F04B 49/20* (2013.01); *F04B 45/047* (2013.01); *F04B 49/06* (2013.01); *F04B 51/00* (2013.01)

(58) Field of Classification Search

CPC ... F04B 17/003; F04B 45/047; A61B 5/02141
USPC ..... 417/45
See application file for complete search history.

(56) References Cited

U.S. PATENT DOCUMENTS

| | | | | |
|---|---|---|---|---|
| 3,563,672 A * | 2/1971 | Bergstrom | ..... | G05D 16/2066 417/45 |
| 4,501,280 A * | 2/1985 | Hood, Jr. | ..... | A61B 5/02141 600/490 |
| 5,221,189 A * | 6/1993 | Henningsen | ..... | F04B 49/022 417/12 |
| 5,295,790 A * | 3/1994 | Bossart | ..... | F04B 49/06 417/234 |

(Continued)

FOREIGN PATENT DOCUMENTS

| | | | | |
|---|---|---|---|---|
| WO | WO-2008050786 A1 * | 5/2008 | ..... | A61B 5/02141 |
| WO | WO-2013108460 A1 * | 7/2013 | ..... | A61B 5/0225 |

(Continued)

*Primary Examiner* — Patrick Hamo
(74) *Attorney, Agent, or Firm* — Kirton McConkie; Evan R. Witt

(57) ABSTRACT

A control method of a driving circuit is provided for controlling a piezoelectric actuator of a piezoelectric pump to move a fluid of a fluid reservoir. Firstly, a driving voltage is outputted from the driving circuit. Then, a first inhalation adjusting process is implemented while the piezoelectric pump performs an inhaling operation. In the first inhalation adjusting process, a fluid pressure of the fluid within the fluid reservoir is detected and the fluid pressure is adjusted to the first predetermined inhalation pressure value according to the detecting result. Then, a first exhalation adjusting process is performed while the piezoelectric pump performs an exhaling operation. In the first exhalation adjusting process, the fluid pressure is detected and the fluid pressure is adjusted to the first predetermined exhalation pressure value according to the detecting result.

10 Claims, 5 Drawing Sheets

(56) References Cited

U.S. PATENT DOCUMENTS

| | | | | |
|---|---|---|---|---|
| 5,630,709 | A * | 5/1997 | Bar-Cohen | F04B 7/0076 417/322 |
| 6,228,035 | B1 * | 5/2001 | Packman | A61B 5/02141 128/900 |
| 6,520,746 | B2 * | 2/2003 | Yoo | F04B 49/065 417/18 |
| 9,198,584 | B2 * | 12/2015 | Yamashita | A61B 5/0225 |
| 9,456,259 | B1 * | 9/2016 | Liao | G08C 17/02 |
| 2011/0152650 | A1 * | 6/2011 | Donehoo | A61B 5/02141 600/324 |
| 2013/0337355 | A1 * | 12/2013 | Mitsui | H01M 8/04104 429/431 |
| 2015/0034847 | A1 * | 2/2015 | Kotani | F04B 43/043 251/57 |
| 2015/0094602 | A1 * | 4/2015 | Yamashita | A61B 5/0225 600/494 |
| 2017/0313395 | A1 * | 11/2017 | Yuan | A61B 5/0006 |
| 2018/0177414 | A1 * | 6/2018 | Tokko | A61B 5/022 |
| 2018/0235488 | A1 * | 8/2018 | Aelen | A61B 5/02225 |
| 2018/0368704 | A1 * | 12/2018 | Kawamura | A61B 5/02233 |
| 2019/0014998 | A1 * | 1/2019 | Kurachi | A61B 5/02233 |

FOREIGN PATENT DOCUMENTS

| | | | | |
|---|---|---|---|---|
| WO | WO-2013179789 | A1 * | 12/2013 | F04B 43/046 |
| WO | WO-2016063710 | A1 * | 4/2016 | A61B 5/0235 |

* cited by examiner

DRIVING CIRCUIT FOR PIEZOELECTRIC PUMP AND CONTROL METHOD THEREOF

FIELD OF THE INVENTION

The present invention relates to a driving circuit and a control method, and more particularly to a driving circuit for a piezoelectric pump and a control method thereof.

BACKGROUND OF THE INVENTION

Generally, a piezoelectric pump comprises a piezoelectric actuator. Moreover, a driving circuit is needed to drive the piezoelectric actuator, and thus the piezoelectric pump is correspondingly operated.

Conventionally, the driving circuit issues a fixed driving voltage at a fixed frequency to the piezoelectric actuator of the piezoelectric pump when the piezoelectric pump is enabled. Moreover, the driving circuit stops issuing the driving voltage when the piezoelectric pump is disabled. That is, the conventional driving circuit is only able to control the on/off states and the duration of the piezoelectric pump. The conventional piezoelectric pump can be easily operated. However, because of the process variation or other factors, the performance of different piezoelectric pumps may be somewhat different. When the conventional driving circuit is applied to different piezoelectric pumps, the driving results of different piezoelectric pumps are possibly different.

Moreover, the driving circuit issues the fixed driving voltage at the fixed frequency to the piezoelectric actuator of the piezoelectric pump, the pressure of the fluid inhaled or exhaled by the piezoelectric pump cannot be adjusted as required. If the user intends to adjust the pressure of the fluid to a specified value within a specified time interval, an additional fluid control valve is needed. The use of the additional fluid control valve increases the fabricating cost. Moreover, it is difficult to precisely control the fluid control valve, and the use life of the fluid control valve is usually not long. In other words, the fluid control valve is not feasible.

Therefore, there is a need of providing a driving circuit for a piezoelectric pump and a control method thereof in order to eliminate the above drawbacks.

SUMMARY OF THE INVENTION

An object of the present invention provides a driving circuit for a piezoelectric pump and a control method of the driving circuit in order to precisely control the fluid pressure and reduce the fabricating cost and the power loss.

In accordance with an aspect of the present invention, there is provided a control method of a driving circuit for controlling a piezoelectric actuator of a piezoelectric pump to move a fluid of a fluid reservoir. Firstly, the driving circuit is enabled, and thus a driving voltage is outputted from the driving circuit. Then, a first inhalation adjusting process is implemented while the piezoelectric pump performs an inhaling operation. In the first inhalation adjusting process, a fluid pressure of the fluid within the fluid reservoir is detected and a magnitude of the driving voltage is adjusted according to a result of comparing the fluid pressure with a first predetermined inhalation pressure value, so that the fluid pressure is adjusted to the first predetermined inhalation pressure value. Then, a first exhalation adjusting process is performed while the piezoelectric pump performs an exhaling operation. In the first exhalation adjusting process, the fluid pressure is detected and the magnitude of the driving voltage is adjusted according to a result of comparing the fluid pressure with a first predetermined exhalation pressure value, so that the fluid pressure is adjusted to the first predetermined exhalation pressure value.

In accordance with another aspect of the present invention, there is provided a driving circuit for driving a piezoelectric actuator of a piezoelectric pump to move a fluid of a fluid reservoir. The driving circuit includes a power-providing circuit, a pressure detector and a control circuit. The power-providing circuit is electrically connected with the piezoelectric actuator. The power-providing circuit receives an input voltage, converts the input voltage into a driving voltage, and issues the driving voltage to the piezoelectric actuator. The pressure detector is connected with the fluid reservoir for detecting a fluid pressure of the fluid within the fluid reservoir in real time. The control circuit is electrically connected with the power-providing circuit and the pressure detector for controlling the power-providing circuit and receiving a detecting result of the pressure detector. When the piezoelectric pump performs an inhaling operation, the control circuit controls the power-providing circuit to adjust a magnitude of the driving voltage according to a result of comparing the fluid pressure with a predetermined inhalation pressure value, so that the fluid pressure is adjusted to the predetermined inhalation pressure value. When the piezoelectric pump performs an exhaling operation, the control circuit controls the power-providing circuit to adjust the magnitude of the driving voltage according to a result of comparing the fluid pressure with a predetermined exhalation pressure value, so that the fluid pressure is adjusted to the predetermined exhalation pressure value.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
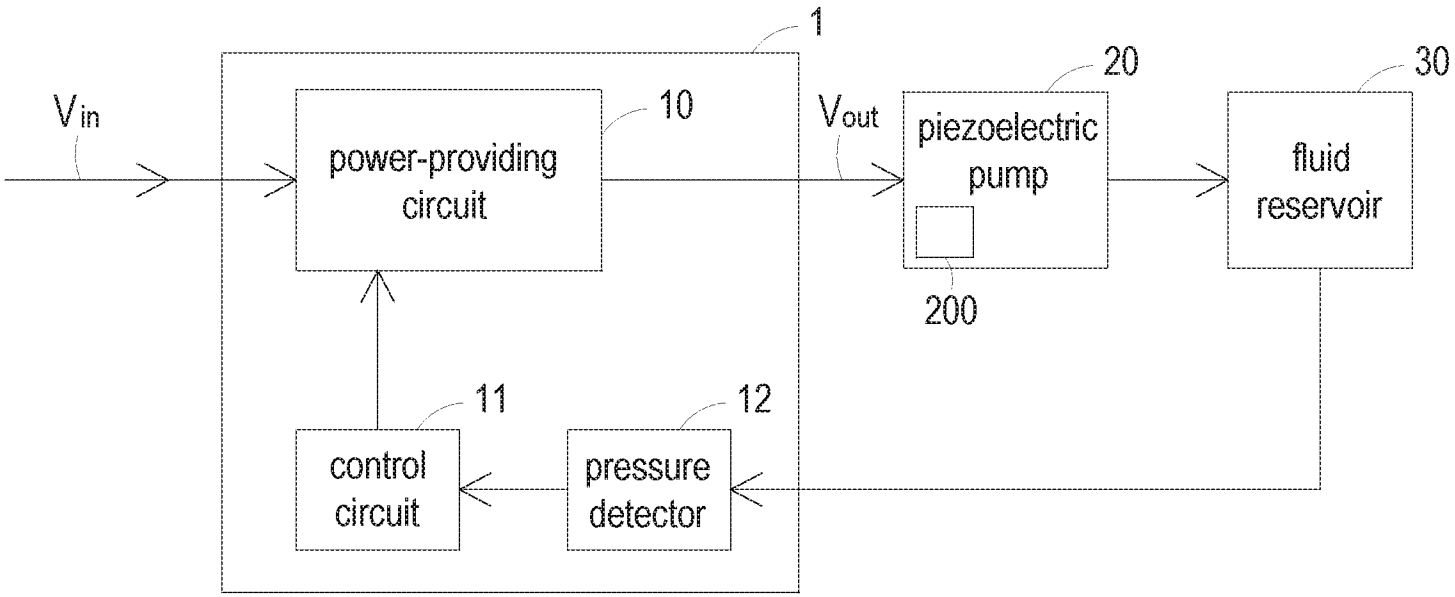
FIG. 1 schematically illustrates the architecture of a driving circuit for a piezoelectric pump according to an embodiment of the present invention.

FIG. 1 schematically illustrates the architecture of a driving circuit for a piezoelectric pump according to an embodiment of the present invention. The driving circuit 1 is electrically connected with a piezoelectric pump 20. The driving circuit 1 receives an input voltage Vin and converts the input voltage Vin into a driving voltage Vout. The driving voltage Vout is provided to a piezoelectric actuator 200 of the piezoelectric pump 20. According to the driving voltage Vout, the piezoelectric actuator 200 converts electrical energy into mechanical energy in order to drive operation of the piezoelectric pump 20.

The piezoelectric pump 20 is applied to a pharmaceutical industry, a computer industry, a printing industry or an energy industry. The piezoelectric pump 20 is in communication with a fluid reservoir 30 that stores fluid. While an inhaling operation or an exhaling operation of the piezoelectric pump 20 is performed, the fluid is moved by the piezoelectric pump 20. In response to the inhaling operation of the piezoelectric pump 20, the external fluid of the fluid reservoir 30 is inputted into the fluid reservoir 30. In response to the exhaling operation of the piezoelectric pump 20, the internal fluid of the fluid reservoir 30 is outputted from the fluid reservoir 30.

As shown in FIG. 1, the driving circuit 1 comprises a power-providing circuit 10, a control circuit 11 and a pressure detector 12. The power-providing circuit 10 is electrically connected with the piezoelectric actuator 200. The power-providing circuit 10 receives the input voltage Vin and converts the input voltage Vin into the driving voltage Vout. The pressure detector 12 is connected with the fluid reservoir 30 in order to detect a fluid pressure of the fluid within the fluid reservoir 30 in real time.

In this embodiment, the driving voltage Vout is an AC voltage. When the polarity of the driving voltage Vout is changed, the vibration direction of the piezoelectric actuator 200 is correspondingly changed.

The control circuit 11 is electrically connected with the power-providing circuit 10 and the pressure detector 12. The control circuit 11 controls the operation of the power-providing circuit 10 and receives a detecting result of the pressure detector 12. When the driving circuit 1 drives the piezoelectric pump 20 to perform the inhaling operation, the control circuit 11 compares the fluid pressure of the fluid reservoir 30 with a predetermined inhalation pressure value. According to the comparing result, the control circuit 11 controls the power-providing circuit 10 to adjust the magnitude of the driving voltage Vout. Consequently, the fluid pressure is adjusted to the predetermined inhalation pressure value. When the driving circuit 1 drives the piezoelectric pump 20 to perform the exhaling operation, the control circuit 11 compares the fluid pressure of the fluid reservoir 30 with a predetermined exhalation pressure value. According to the comparing result, the control circuit 11 controls the power-providing circuit 10 to adjust the magnitude of the driving voltage Vout. Consequently, the fluid pressure is adjusted to the predetermined exhalation pressure value.

In an embodiment, the piezoelectric pump 20 is a piezoelectric air pump, and the fluid reservoir 30 is a gasbag. In some embodiments, the driving circuit 10, the piezoelectric pump 20 and the fluid reservoir 30 are installed in a wearable device. While the fluid (e.g., a gas) is moved in the fluid reservoir 30 by the piezoelectric pump 20, the fluid reservoir 30 is inflated to press a specified site of the user who wears the wearable device. Preferably, the wearable device includes a physiological sensor to sense the physiological information of the user. According to the physiological information of the user, the wearable device performs the subsequent process.

The predetermined inhalation pressure value and the predetermined exhalation pressure value are previously stored in the control circuit 11. Moreover, the values of the predetermined inhalation pressure value and the predetermined exhalation pressure value can be set by the user. The predetermined inhalation pressure value is the use's anticipated pressure of the fluid pressure of the fluid reservoir 30 when the piezoelectric pump 20 performs the inhaling operation. The predetermined exhalation pressure value is the use's anticipated pressure of the fluid pressure of the fluid reservoir 30 when the piezoelectric pump 20 performs the exhaling operation.

For controlling the fluid pressure of the fluid reservoir 30 more precisely, the above control method can be further modified. In another embodiment, the fluid pressure of the fluid reservoir 30 is adjusted in a stepwise manner. The way of adjusting the fluid pressure of the fluid reservoir 30 in the stepwise manner can reduce noise or avoid the noise generation. In an embodiment, the fluid pressure of the fluid reservoir 30 is adjusted to different pressures in multiple stages when the inhaling operation or the exhaling operation is performed. That is, plural inhalation pressure values (e.g., a first inhalation pressure value and a second inhalation pressure value) and plural predetermined exhalation pressure values (e.g., a first predetermined exhalation pressure value and a second predetermined exhalation pressure value) are previously stored in the control circuit 11. When the driving circuit 1 drives the piezoelectric pump 20 to perform the inhaling operation, the control circuit 11 controls the power-providing circuit 10 to adjust the magnitude of the driving voltage Vout according to a result of comparing the fluid pressure of the fluid reservoir 30 with the first predetermined inhalation pressure value. Consequently, the fluid pressure is adjusted to the first predetermined inhalation pressure value. Then, the control circuit 11 controls the power-providing circuit 10 to adjust the magnitude of the driving voltage Vout according to a result of comparing the fluid pressure of the fluid reservoir 30 with the second predetermined inhalation pressure value. Consequently, the fluid pressure is adjusted to the second predetermined inhalation pressure value.

Similarly, when the driving circuit 1 drives the piezoelectric pump 20 to perform the exhaling operation, the control circuit 11 controls the power-providing circuit 10 to adjust the magnitude of the driving voltage Vout according to a result of comparing the fluid pressure of the fluid reservoir 30 with the first predetermined exhalation pressure value. Consequently, the fluid pressure is adjusted to the first predetermined exhalation pressure value. Then, the control circuit 11 controls the power-providing circuit 10 to adjust the magnitude of the driving voltage Vout according to a result of comparing the fluid pressure of the fluid reservoir 30 with the second predetermined exhalation pressure value. Consequently, the fluid pressure is adjusted to the second predetermined exhalation pressure value.

Figure 2:
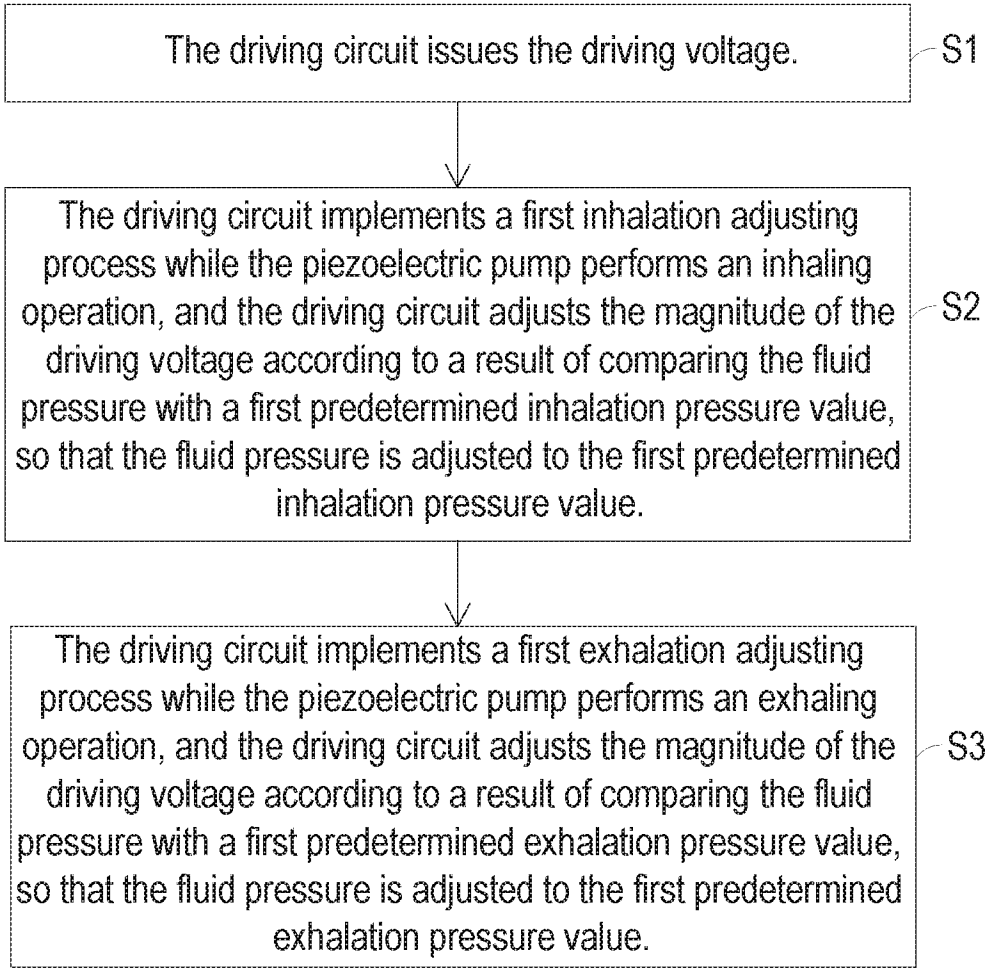
FIG. 2 is a flowchart of a control method for the driving circuit of FIG. 1.

FIG. 2 is a flowchart of a control method for the driving circuit of FIG. 1.

In a step S1, the driving circuit 1 is enabled. Consequently, the driving circuit 1 issues the driving voltage Vout to the piezoelectric pump 20.

In a step S2, the driving circuit 1 implements a first inhalation adjusting process while the piezoelectric pump 20 performs an inhaling operation. In the first inhalation adjusting process, the pressure detector 12 detects the fluid pressure of the fluid within the fluid reservoir 30 in real time. According to a result of comparing the fluid pressure of the fluid reservoir 30 with the first predetermined inhalation pressure value, the control circuit 11 adjusts the magnitude of the driving voltage Vout. Consequently, the fluid pressure is adjusted to the first predetermined inhalation pressure value.

In a step S3, the driving circuit 1 implements a first exhalation adjusting process after the piezoelectric pump 20 performs an exhaling operation. In the first exhalation adjusting process, the pressure detector 12 detects the fluid pressure of the fluid within the fluid reservoir 30 in real time. According to a result of comparing the fluid pressure of the fluid reservoir 30 with the first predetermined exhalation pressure value, the control circuit 11 adjusts the magnitude of the driving voltage Vout. Consequently, the fluid pressure is adjusted to the first predetermined exhalation pressure value.

As mentioned above, the pressure detector 12 is employed to detect the fluid pressure of the fluid within the fluid reservoir 30. According to a result of comparing the fluid pressure of the fluid reservoir 30 with the predetermined exhalation pressure value, the control circuit 11 adjusts the magnitude of the driving voltage Vout to be adjusted to the predetermined exhalation pressure value. Since it is not necessary to installs an additional fluid control valve, the driving circuit 1 is cost-effective. Moreover, in comparison with the conventional technology, the driving voltage Vout from the driving circuit 1 of the present invention is adjustable. Consequently, after the driving circuit 1 is enabled, the power loss resulted from surge is largely reduced.

In an embodiment, the step S3 is performed after the step S2 has been performed for a first predetermined time period. In an embodiment, the step S3 is performed immediately after the step S2 is performed. Moreover, the step S2 is performed again after the step S3 is completed. Consequently, the inhaling operation and the exhaling operation are alternately performed. In an embodiment, the step S2 is performed after the step S3 has been performed for a second predetermined time period. Moreover, the step S2 is performed immediately after the step S3 is performed.

In another embodiment, the driving circuit 1 further implements a second inhalation adjusting process while the piezoelectric pump 20 performs the inhaling operation in the step S2. In the second inhalation adjusting process, the pressure detector 12 detects the fluid pressure of the fluid within the fluid reservoir 30 in real time. According to a result of comparing the fluid pressure of the fluid reservoir 30 with the second predetermined inhalation pressure value, the control circuit 11 adjusts the magnitude of the driving voltage Vout. Consequently, the fluid pressure is adjusted to the second predetermined inhalation pressure value.

In another embodiment, the driving circuit 1 further implements a second exhalation adjusting process while the piezoelectric pump 20 performs the exhaling operation in the step S3. In the second exhalation adjusting process, the pressure detector 12 detects the fluid pressure of the fluid within the fluid reservoir 30 in real time. According to a result of comparing the fluid pressure of the fluid reservoir 30 with the second predetermined exhalation pressure value, the control circuit 11 adjusts the magnitude of the driving voltage Vout. Consequently, the fluid pressure is adjusted to the second predetermined exhalation pressure value.

It is noted that the control method can be further modified. For example, a first target slope value is previously stored in the control circuit 11. While the piezoelectric pump 20 performs the inhaling operation, the control circuit 11 adjusts the fluid pressure corresponding to the output voltage Vout according to the first target slope value. Consequently, the fluid pressure is adjusted to the first predetermined exhalation pressure value at a desired rate. In the step S2, the driving circuit 1 further obtains a derivative of the fluid pressure with respect to time according to differential calculus and compares the derivative with the first target slope value. If the derivative of the fluid pressure is smaller than the first target slope value, the output voltage Vout is increased. Whereas, if the derivative of the fluid pressure is larger than the first target slope value, the output voltage Vout is decreased.

Moreover, a second target slope value is previously stored in the control circuit 11. While the piezoelectric pump 20 performs the exhaling operation, the control circuit 11 adjusts the fluid pressure corresponding to the output voltage Vout according to the second target slope value. Consequently, the fluid pressure is adjusted to the second predetermined exhalation pressure value at a desired rate. In the step S3, the driving circuit 1 further obtains a derivative of the fluid pressure with respect to time according to differential calculus and compares the derivative with the first target slope value. If the derivative of the fluid pressure is smaller than the second target slope value, the output voltage Vout is increased. Whereas, if the derivative of the fluid pressure is larger than the second target slope value, the output voltage Vout is decreased.

From the above descriptions, the fluid pressure is dynamically adjusted while the piezoelectric pump 20 performs the inhaling operation or the exhaling operation. Consequently, the fluid pressure is adjusted to the predetermined pressure value at the desired rate In the following example, three predetermined inhalation pressure values (i.e., a first predetermined inhalation pressure value, a second predetermined inhalation pressure value and a third predetermined inhalation pressure value) and three predetermined exhalation pressure values (i.e., a first predetermined exhalation pressure value, a second predetermined exhalation pressure value and a third predetermined exhalation pressure value) are previously stored in the control circuit 11. For succinctness, the first predetermined inhalation pressure value is equal to the first predetermined exhalation pressure value, the second predetermined inhalation pressure value is equal to the second predetermined exhalation pressure value, and the third predetermined inhalation pressure value is equal to the third predetermined exhalation pressure value.

Figure 3:
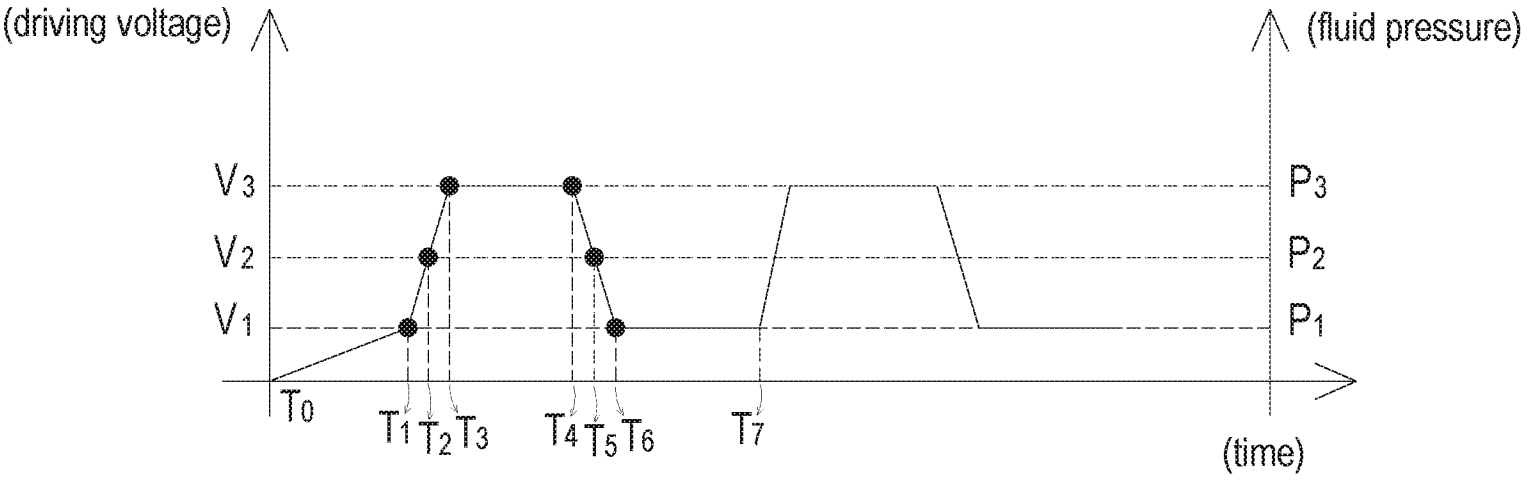
FIG. 3 is a schematic timing waveform diagram illustrating the change of the fluid pressure adjusted by the driving circuit according to embodiment of the present invention.
Figure 4:
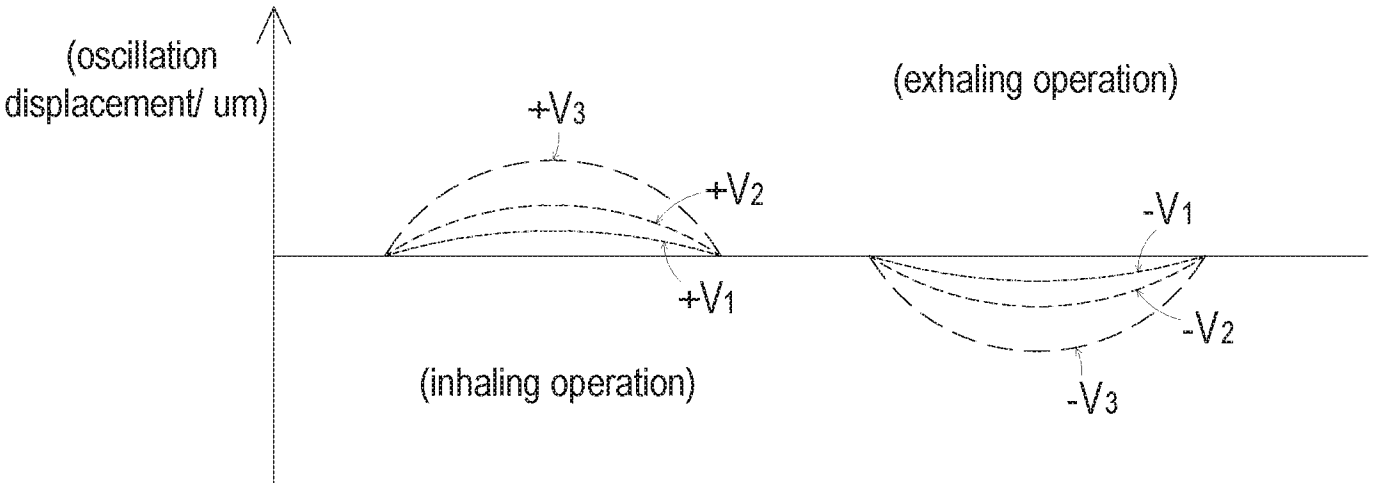
FIG. 4 is a schematic timing waveform diagram illustrating the change of the oscillation displacement generated by the piezoelectric actuator of the piezoelectric pump.
Figure 5:
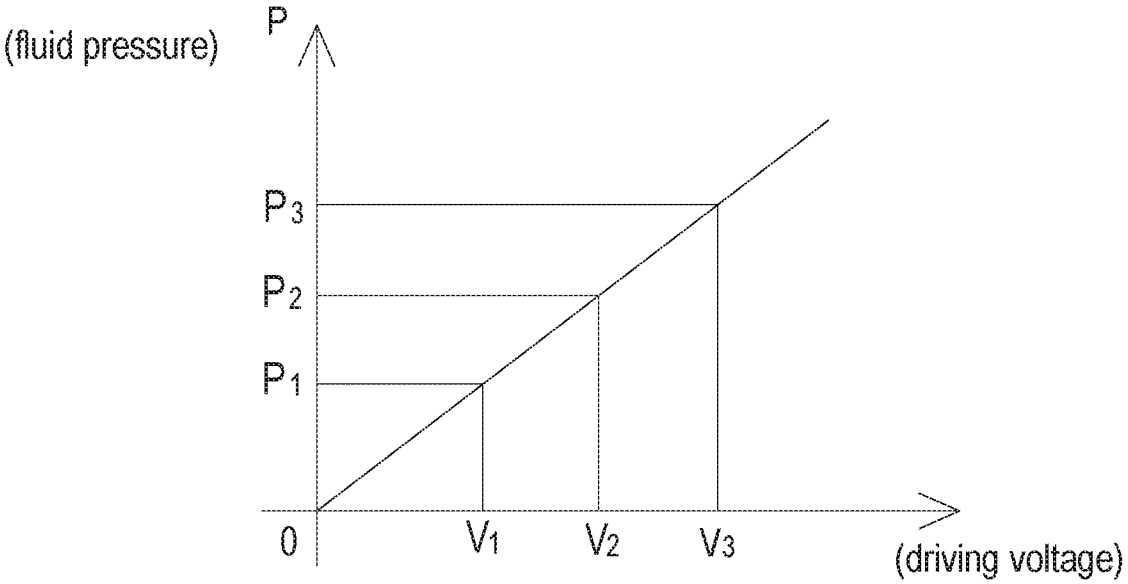
FIG. 5 is a plot illustrating the relationship between the driving voltage and the fluid pressure of FIG. 3.

FIG. 3 is a schematic timing waveform diagram illustrating the change of the fluid pressure adjusted by the driving circuit according to embodiment of the present invention. FIG. 4 is a schematic timing waveform diagram illustrating the change of the oscillation displacement generated by the piezoelectric actuator of the piezoelectric pump. FIG. 5 is a plot illustrating the relationship between the driving voltage and the fluid pressure of FIG. 3.

At the time point T0, the driving circuit 1 is enabled. Meanwhile, the driving circuit 1 generates the driving voltage Vout, and the piezoelectric pump 20 starts performing the inhaling operation. Then, the driving circuit 1 implements a first inhalation adjusting process. In the first inhalation adjusting process, the pressure detector 12 detects the fluid pressure of the fluid within the fluid reservoir 30 in real time. The control circuit 11 adjusts the magnitude of the driving voltage Vout, and thus the fluid pressure is adjusted to the first predetermined inhalation pressure value (e.g., P1 as shown in FIG. 3). At the time point T1, the driving voltage Vout is adjusted to a first voltage V1, and the fluid pressure reaches the first predetermined inhalation pressure value P1. Then, the driving circuit 1 implements a second inhalation adjusting process. In the second inhalation adjusting process, the pressure detector 12 detects the fluid pressure of the fluid within the fluid reservoir 30 in real time. The control circuit 11 adjusts the magnitude of the driving voltage Vout, and thus the fluid pressure is adjusted to the second predetermined inhalation pressure value (e.g., P2 as shown in FIG. 3). At the time point T2, the driving voltage Vout is adjusted to a second voltage V2, and the fluid pressure reaches the second predetermined inhalation pressure value P2. Then, the driving circuit 1 implements a third inhalation adjusting process. In the third inhalation adjusting process, the pressure detector 12 detects the fluid pressure of the fluid within the fluid reservoir 30 in real time. The control circuit 11 adjusts the magnitude of the driving voltage Vout, and thus the fluid pressure is adjusted to the third predetermined inhalation pressure value (e.g., P3 as shown in FIG. 3). At the time point T3, the driving voltage Vout is adjusted to a third voltage V3, and the fluid pressure reaches the third predetermined inhalation pressure value P3.

At the time point T4, the driving circuit 1 generates the driving voltage Vout, and the piezoelectric pump 20 starts performing the exhaling operation. Then, the driving circuit 1 implements a first exhalation adjusting process. In the first exhalation adjusting process, the pressure detector 12 detects the fluid pressure of the fluid within the fluid reservoir 30 in real time. The control circuit 11 adjusts the magnitude of the driving voltage Vout, and thus the fluid pressure is adjusted to the first predetermined exhalation pressure value (e.g., P3 as shown in FIG. 3). Since the fluid pressure is equal to the first predetermined exhalation pressure value P3 at the time point T4, it is not necessary to adjust the magnitude of the driving voltage Vout. Then, the driving circuit 1 implements a second exhalation adjusting process. In the second exhalation adjusting process, the pressure detector 12 detects the fluid pressure of the fluid within the fluid reservoir 30 in real time. The control circuit 11 adjusts the magnitude of the driving voltage Vout, and thus the fluid pressure is adjusted to the second predetermined exhalation pressure value (e.g., P2 as shown in FIG. 3). At the time point T5, the driving voltage Vout is adjusted to the second voltage V2, and the fluid pressure reaches the second predetermined exhalation pressure value P2. Then, the driving circuit 1 implements a third exhalation adjusting process. In the third exhalation adjusting process, the pressure detector 12 detects the fluid pressure of the fluid within the fluid reservoir 30 in real time. The control circuit 11 adjusts the magnitude of the driving voltage Vout, and thus the fluid pressure is adjusted to the third predetermined exhalation pressure value (e.g., P1 as shown in FIG. 3). At the time point T6, the driving voltage Vout is adjusted to the first voltage V1, and the fluid pressure reaches the third predetermined exhalation pressure value P1. At the time point T7, the piezoelectric pump 20 performs the inhaling operation again. The subsequent steps are the same as the above steps, and are not redundantly described herein.

As shown in FIG. 3, the time interval between the time point T3 and the time point T4 is the first predetermined time period, and the time interval between the time point T6 and the time point T7 is the second predetermined time period. As shown in FIG. 4, the vibration direction of the piezoelectric actuator 200 corresponding to the inhaling operation and the vibration direction of the piezoelectric actuator 200 corresponding to the exhaling operation are opposite because the polarities of the driving voltage Vout are opposite.

From the above descriptions, the present invention provides a driving circuit for a piezoelectric pump and a control method thereof. In accordance with the present invention, the fluid pressure of the fluid within the fluid reservoir is detected and the magnitude of the driving voltage is adjusted according to the result of comparing the fluid pressure with the predetermined pressure value. Consequently, the fluid pressure is adjusted to the predetermined pressure value. Since it is not necessary to installs an additional fluid control valve, the driving circuit is cost-effective. Moreover, after the driving circuit is enabled, the power loss resulted from surge is largely reduced.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A control method of a driving circuit for controlling a piezoelectric actuator of a piezoelectric pump to move a fluid of a fluid reservoir, the control method comprising steps of:

(a) enabling the driving circuit, and outputting a driving voltage from the driving circuit;

(b) implementing a first inhalation adjusting process while the piezoelectric pump performs an inhaling operation, wherein in the first inhalation adjusting process, a fluid pressure of the fluid within the fluid reservoir is detected and a magnitude of the driving voltage is adjusted according to a result of comparing the fluid pressure with a first predetermined inhalation pressure value, so that the fluid pressure is adjusted to the first predetermined inhalation pressure value; and (c) implementing a first exhalation adjusting process while the piezoelectric pump performs an exhaling operation, wherein in the first exhalation adjusting process, the fluid pressure is detected and the magnitude of the driving voltage is adjusted according to a result of comparing the fluid pressure with a first predetermined exhalation pressure value, the first predetermined exhalation pressure value being determined separately from the first predetermined inhalation pressure value, so that the fluid pressure is adjusted to the first predetermined exhalation pressure value.

2. The control method according to claim 1, wherein the step (c) is subsequently performed after the step (b) has been performed for a first predetermined time period.

3. The control method according to claim 1, wherein the step (b) is performed again after the step (c) is completed, so that the inhaling operation and the exhaling operation are alternately performed.

4. The control method according to claim 3, wherein the step (b) is performed again after the step (c) has been performed for a second predetermined time period.

5. The control method according to claim 1, further implementing a second inhalation adjusting process while the piezoelectric pump performs the inhaling operation in the step (b), wherein in the second inhalation adjusting process, the fluid pressure is detected and the magnitude of the driving voltage is adjusted according to a result of comparing the fluid pressure with a second predetermined inhalation pressure value, so that the fluid pressure is adjusted to the second predetermined inhalation pressure value.

6. The control method according to claim 1, further implementing a second exhalation adjusting process while the piezoelectric pump performs the exhaling operation in the step (c), wherein in the second exhalation adjusting process, the fluid pressure is detected and the magnitude of the driving voltage is adjusted according to a result of comparing the fluid pressure with a second predetermined exhalation pressure value, so that the fluid pressure is adjusted to the second predetermined exhalation pressure value.

7. The control method according to claim 1, further obtaining a derivative of the fluid pressure with respect to time according to differential calculus and comparing the derivative with a first target slope value while the piezoelectric pump performs the inhaling operation in the step (b), wherein the output voltage is increased if the derivative of the fluid pressure is smaller than the first target slope value, and the output voltage is decreased if the derivative of the fluid pressure is larger than the first target slope value, so that the fluid pressure is adjusted to the first predetermined inhalation pressure value.

8. The control method according to claim 1, further obtaining a derivative of the fluid pressure with respect to time according to differential calculus and comparing the derivative with a second target slope value while the piezoelectric pump performs the exhaling operation in the step (c), wherein the output voltage is increased if the derivative of the fluid pressure is smaller than the second target slope value, and the output voltage is decreased if the derivative of the fluid pressure is larger than the second target slope value, so that the fluid pressure is adjusted to the first predetermined exhalation pressure value.

9. A driving circuit for driving a piezoelectric actuator of a piezoelectric pump to move a fluid of a fluid reservoir, the driving circuit comprising:

a power-providing circuit electrically connected with the piezoelectric actuator, wherein the power-providing circuit receives an input voltage, converts the input voltage into a driving voltage, and issues the driving voltage to the piezoelectric actuator;

a pressure detector connected with the fluid reservoir for detecting a fluid pressure of the fluid within the fluid reservoir in real time; and a control circuit electrically connected with the power-providing circuit and the pressure detector for controlling the power-providing circuit and receiving a detecting result of the pressure detector, wherein when the piezoelectric pump performs an inhaling operation, the control circuit controls the power-providing circuit to adjust a magnitude of the driving voltage according to a result of comparing the fluid pressure with a predetermined inhalation pressure value, so that the fluid pressure is adjusted to the predetermined inhalation pressure value, wherein when the piezoelectric pump performs an exhaling operation, the control circuit controls the power-providing circuit to adjust the magnitude of the driving voltage according to a result of comparing the fluid pressure with a predetermined exhalation pressure value, the predetermined exhalation pressure value being determined separately from the predetermined inhalation pressure value, so that the fluid pressure is adjusted to the predetermined exhalation pressure value.

10. The driving circuit according to claim 9, wherein the piezoelectric pump is a piezoelectric air pump, and the fluid reservoir is a gasbag.

* * * * *